United States Patent [19]

Dawson et al.

[11] 4,416,631

[45] Nov. 22, 1983

[54] SMALL ARMS FIRING EFFECTS SIMULATOR

[75] Inventors: Christopher R. Dawson, Glendora; Ronald E. Purkis, Upland, both of Calif.

[73] Assignee: The United States of America as represented by the Secretary of the Navy, Washington, D.C.

[21] Appl. No.: 375,797

[22] Filed: May 8, 1982

[51] Int. Cl.[3] ..... F41C 13/00

[52] U.S. Cl. ..... 434/16; 102/447; 102/432; 42/6

[58] Field of Search ..... 434/18, 16, 21, 22, 434/24; 273/310–313; 42/6, 17, 69 R; 102/432, 444, 447; 340/384 R, 384 E

[56] References Cited

U.S. PATENT DOCUMENTS

| | | | |
|---|---|---|---|
| 1,875,941 | 9/1932 | Schwartz | 42/1 MH |
| 2,337,145 | 12/1943 | Albree | 42/1 MH |
| 2,828,568 | 4/1958 | Sakewitz | 42/6 |
| 2,836,919 | 6/1958 | Dubois | 42/57 |
| 3,214,857 | 11/1965 | Tyrone et al. | 42/69 R |
| 3,217,601 | 11/1965 | Gardner | 89/135 |
| 3,712,230 | 1/1973 | Hoffmann | 102/70.2 |
| 3,736,686 | 6/1973 | Moller et al. | 42/6 |
| 3,815,271 | 6/1974 | Lynn | 42/84 |
| 3,935,816 | 2/1976 | Boquette, Jr. | 102/444 |
| 4,019,273 | 4/1977 | Kisler | 42/1 R |
| 4,217,717 | 8/1980 | Canty et al. | 42/1 R |

*Primary Examiner*—Vance Y. Hum
*Assistant Examiner*—Leo P. Picard
*Attorney, Agent, or Firm*—Robert F. Beers; Robert W. Adams; Robert J. Veal

[57] ABSTRACT

A small arms firing effects simulator utilizes a modular construction to integrate with the magazine of a weapon such as a rifle. The modular design resembles the ammunition clip and houses an expendable plastic coated plurality of pyrotechnic charges. An electrical control circuit is also housed within the module and serves to interface the pyrotechnic charges with the firing of the weapon, including semi-automatic and automatic firing as well as disabling the weapon when all rounds have been fired.

13 Claims, 5 Drawing Figures

SMALL ARMS FIRING EFFECTS SIMULATOR

BACKGROUND OF THE INVENTION

1. Field of the Invention

The present invention relates to military weapons and particularly to apparatus for simulating the sound and flash thereof. More particularly, the present invention may be described as an electronically controlled pyrotechnic sound and flash simulator for use with small arms training.

2. Description of the Prior Art

In recent years, the armed forces have placed an increasing emphasis on the realism of battlefield training conditions. In U.S. Pat. No. 3,836,919 entitled "Small Weapons Noise Simulator," which issued June 3, 1958 to Edwin R. DuBois, there is shown an electromechanical small weapons noise simulator which can be attached to a weapon.

Currently with regard to the standard M16 automatic weapon, the armed forces use blanks and a blank fire adapter. The sound levels produced by this method are far below that of live round fire. Inasmuch as each M16 blank is estimated to cost at least 8.5 cents, training with such is quite expensive.

SUMMARY OF THE INVENTION

The present invention represents a cost effective means for simulating small arms fire without modifying the weapon and without the use of mechanical actuation, other than in electrical switches. The present invention utilizes a low cost plastic expendable housing a metal/oxidizer pyrotechnic in conjunction with an electrical ignition system. The expendable would contain a plurality of rounds and would be installed in a firing unit which can be inserted into the weapon via the magazine breech. The invention produces sound and flash by the electrical ignition of the pyrotechnic in a confined space and venting the combustion produced in a manner which utilizes the weapon's ejection port. The electrical control circuit provides for automatic and semiautomatic fire, and interfaces with the weapon trigger and bolt.

It is an object of this invention to provide a realistic simulation of small arms fire noise and flash.

Another object of the invention is to provide an inexpensive means to provide realistic training using an actual weapon.

Yet another object of the invention is to provide a reliable, low maintenance, reusable small arms training device.

Another object of the present invention is to provide a pyrotechnic simulation of small arms fire without dangerous pressuration of the ignition chamber.

The foregoing and other objects, features and advantages of the invention, and a better understanding of its construction and operation, will become apparent from the following detailed description taken in conjunction with the accompanying drawings.

DESCRIPTION OF THE PREFERRED EMBODIMENT

Figure 1:
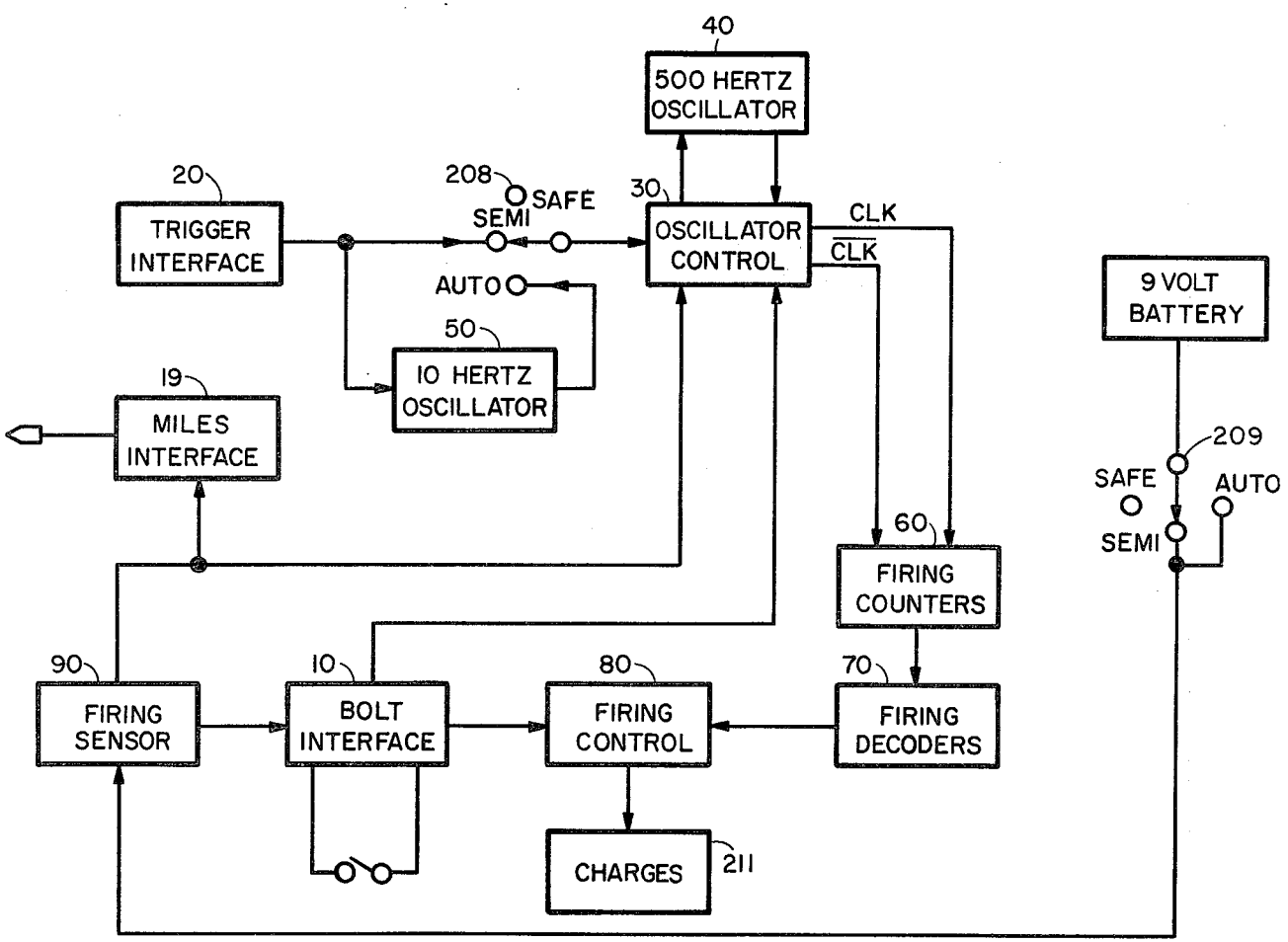
FIG. 1 is a block diagram of the electrical control circuit.
Figure 3B:
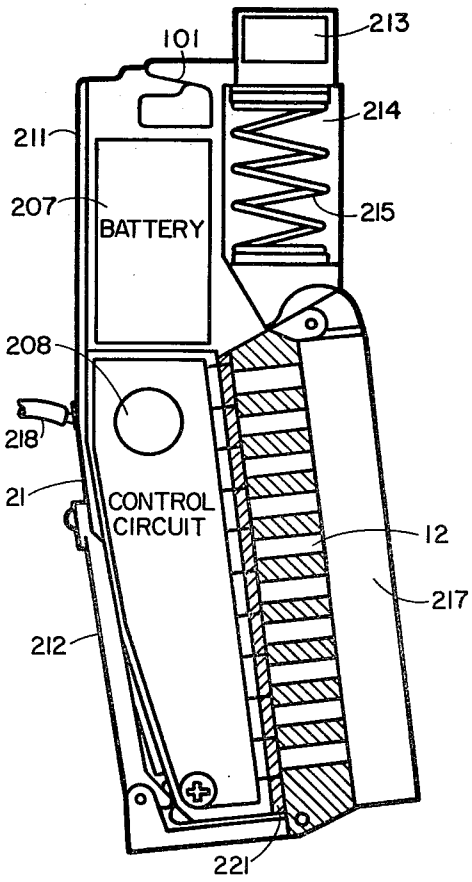
FIGS. 3*a* and 3*b* are an illustration of the expendable.
Figure 3A:
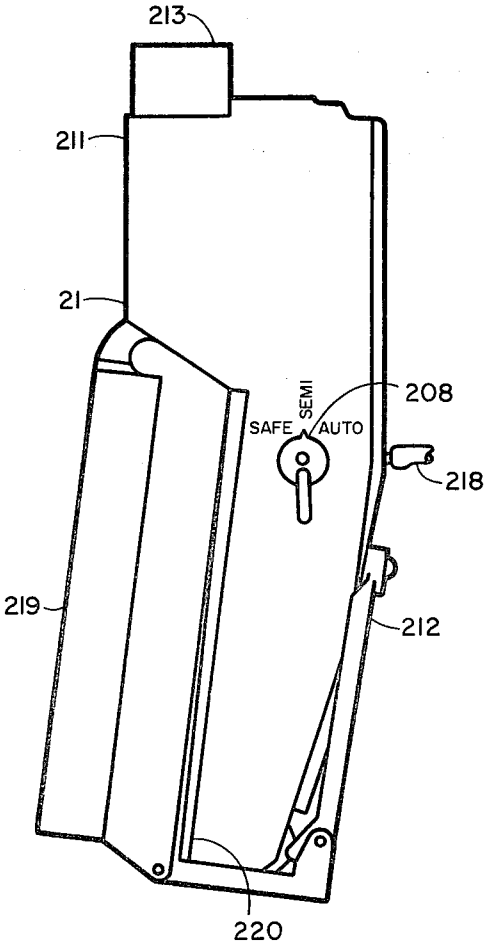

The circuitry of the Small Arms Firing Effect Simulator (SAFES) consists of ten functional blocks as shown in FIG. 1, plus battery and expendable as shown in FIG. 3. Referring to FIG. 1, the embodiment shown in the block diagram utilizes a bolt interface 10, a trigger interface 20, an oscillator control 30, a 500 Hertz oscillator 40, a 10 Hertz oscillator 50, a firing counter 60, firing decoder 70, firing control 80, firing sensors 90, and a Multiple Integrated Laser Engagement System (MILES) interface 19.

Figure 2:
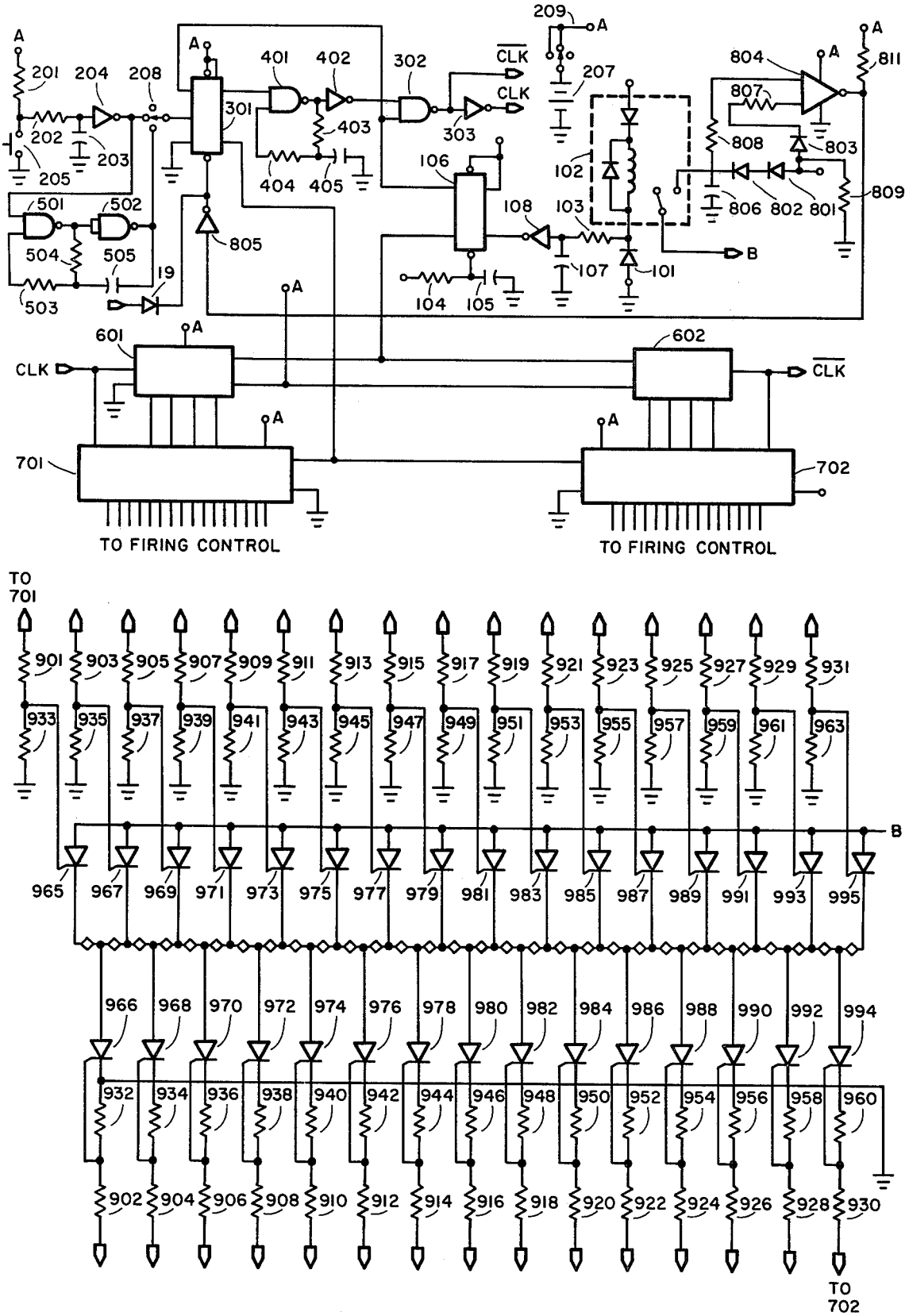
FIG. 2 is a schematic diagram of the electrical control circuit.

The implementation of the functional block diagram is shown in FIG. 2 utilizing seven CMOS IC's, thirty-one SCR's, five diodes, six capacitors, seventy-four resistors, and three switches.

The bolt interface 10 is constructed to provide a realistic simulation of operator actions as would occur during the firing of live rounds. This is accomplished through a microswitch 101 that engages the weapon's bolt as it travels. As shown in FIG. 2, switch 101 is connected to relay 102 and resistor 103. When the weapon bolt is open, or the SAFES unit is out of the weapon, switch 101 is closed, allowing relay 102 contacts to open. With relay 102 open, pyrotechnic charges 11 cannot be fired, a safety precaution which duplicates the action of the weapon.

When the ganged selector switches 208 and 209 are turned to the "Semi" or "Auto" position, the R-C combination of resistor 104 and capacitor 105 resets a bolt flip-flop 106. Flip-flop 106 provides signals to the oscillator control circuit 30 and the firing counter 60, inhibiting their action. Flip-flop 106 is set by the action of microswitch 101, which is debounced through the use of resistor 102 and a capacitor 107 in conjunction with a Schmitt trigger 108.

Trigger interface 20 utilizes a resistor 201, a resistor 202, a capacitor 203, a Schmitt trigger 204, and a dome switch 205, which is normally open. The action of switch 205 is debounced by the R-C time constant of resistor 202 and capacitor 203. The fall in voltage is detected by Schmitt trigger 204 and when triggered, the output of Schmitt trigger 204 goes high. Schmitt trigger 204 has its output connected to the semi position of selector switch 208 and to an input to a NAND gate 501 in 10 Hertz oscillator 50.

Oscillator control 30 uses a D flip-flop 301, a NAND gate 302, and an inverter 33. Flip-flop 301 is clocked by the signal from trigger interface 20 when selector switch 208 is in the semi position, and by the output of 10 Hertz oscillator 50 in the auto position. The level of the input to flip-flop 301 from bolt interface 10 determines the state of the output to 500 Hertz oscillator 40 when flip-flop 301 is clocked. If bolt actuation has taken place, 500 Hertz oscillator 40 is enabled. Flip-flop 301 is reset, inhibiting 500 Hertz oscillator 40, only by a signal from firing sensor 80.

NAND gate 302 serves to control the output of 500 Hertz oscillator 40 and provides CLK signals used as timing pulses by firing counter 60 and firing decoder 70. Inverter 303 is used to invert part of the CLK signal to $\overline{CLK}$ signal, which is also used by firing counter 60 and firing decoder 70.

500 Hertz oscillator 40 is comprised of a NAND gate 401, an inverter 402, resistors 403 and 404, and a capacitor 405. The input to NAND gate 401 comes from flip-flop 301, with the other input to gate 401 tied to ground via resistor 404 and capacitor 405. When the input from flip-flop 301 is high, 500 Hertz oscillator 40 runs; when the input is low, oscillator 40 is inhibited. The running frequency of oscillator 40 is determined by the values of resistor 403 and capacitor 406. Resistor 404 provides feedback to allow NAND gate 401 to change states. The output of gate 401 is inverted by inverter 402 and input to NAND gate 302.

10 Hertz oscillator 50 utilizes NAND gates 501 and 502, resistors 503 and 504, and capacitor 505. NAND gate 501 is controlled by the signal input from inverter 204 of trigger interface 20. When said signal is high, that is, when the trigger is squeezed, 10 Hertz oscillator 50 operates. The values of resistor 504 and capacitor 505 determine the running frequency. Resistor 503 provides the feedback required to allow NAND gate 501 to changes states. The output of gate 501 serves as the input to gate 502, which has its output connected to the auto position of switch 208, thus reclocking flip-flop 301 at a 10 Hertz rate in the auto mode.

Firing counter 60 consists entirely of a dual binary counter, such as a MC14520. Counters 601 and 602 are held in a reset mode until the actuation of bolt interface 10. A low signal from flip-flop 106 enables counters 601 and 602 to accumulate the CLK and $\overline{\text{CLK}}$ signal, respectively. The outputs of each counter is then fed into one-half of firing decoder 70.

Firing decoder 70 of FIG. 1 consists of firing decoders 701 and 702. Firing decoders 701 and 702, as shown in FIG. 2, are two 4-bit latch/4 to 16 line decoders, such as MC14514's. Decoder 701 receives the count from the CLK counter 601 and decodes it to provide a single pulse on the appropriate line of the sixteen outputs. Decoder 702 performs the same function, but receives its input from $\overline{\text{CLK}}$ counter 602. The outputs of decoders 701 and 702 are connected to the gate resistors 901 through 963 of firing control 90.

The outputs of decoders 701 and 702 are inhibited by a signal derived from oscillator control circuit 30, thus providing a means of stopping the drive to firing control 90 while maintaining the decoded count.

Firing control 90 utilizes thirty-one SCR's of the MCR-106 type, and sixty-two gate resistors. Resistors 901 through 963 are placed in pairs between ground and firing decoder 70 at the gate of each SCR 965 through 995. This is to limit the gate current required from decoders 701 and 702 and to provide temperature stability against false triggering.

The anodes of the odd numbered SCR's 965 through 995 are connected to the contact of relay 102. The cathodes of odd numbered SCR's 965 to 995 are connected to the appropriate side of each pyrotechnic charge 11. The even numbered SCR's 966 to 994 have their cathodes tied to ground and their anodes tied to one side of their appropriate charge 11.

When relay 102's contacts are closed, SCR's 965 to 995 can be triggered by firing decoders 70. The trigger timing is controlled such that only two SCR's are enabled at any time, thus current can only flow through one charge at a time. Each SCR 965 to 995 is triggered until an unexpended charge is found, then the triggering stops until the next fire command is given.

Firing sensor 80 consists of diodes 801, 802, and 803, a voltage comparator 804, capacitor 806, resistors 807, 808, 809, and 811, and inverter 805. These components are connected to provide a signal to oscillator control 30 and a MILES interface at the moment a charge 11 fires. This was accomplished by placing diodes 801 and 802 in the current path which supplies SCR's 965 to 995. The voltage across diodes 801 and 802 is monitored by voltage comparator 804. When current flows through the diodes, firing control 90 has sequenced to an unexpended charge. The resultant voltage drop across the diodes is sensed and forces the output of comparator 804 high. This output is inverted by inverter 805 and used to reset oscillator control flip-flop 301, turning off 500 Hertz oscillator 40.

MILES interface 19 is simply a diode 19, whose cathode is connected to the output of firing sensor 80, connected to the trigger of the MILES unit associated with the weapon.

The particular firing control circuitry shown in FIG. 1 and described hereinabove is for a 30-round magazine insert for use in training combat troops with an M16 rifle with a MILES unit attached thereto. To further enhance the realism, the small arms firing effect simulator is packaged to resemble the magazine clip of the M16. Referring to FIG. 3, the small arms firing effect simulator is packaged within a reusable housing 21 having an upper end 211 and a lower end 212. Upper end 211 is designed for insertion into an M16 in the manner of a magazine clip, said upper end 211 having an exhaust port 213 designed for cooperation with the ejection port of said M16 rifle. Exhaust port 213 communicates with lower end 212 via an upper exhaust chamber 214 with upper end 211. Within upper exhaust chamber 213 is port spring 215 designed to maintain reusable housing 21 in cooperative relation within said M16 rifle.

Within upper end 211, switch 101 of bolt interface 10 is positioned for cooperation with the bolt of said M16. Also within upper end 211 is a battey compartment 216 for housing power supply 207.

Lower end 212 houses the electric control circuitry and the plastic expendable 12 which contains pyrotechnic charges 11. A lower exhaust chamber 217 communicates with upper exhaust chamber 214 to provide a path for the discharge of gases generated by the explosion of pyrotechnic charges 11.

Selector switch 208 is mounted on lower end 212, as is trigger overlay 218 for connecting trigger interface 20 to the weapon.

Plastic expendable 12 is mounted within a hinged chamber block 219 which forms lower exhaust chamber 217 and holds expendable 12 in place in a receiver block 220. Receiver block 220 has contact pins 221 which serve to connect firing control 90 with pyrotechnic charges 11.

Figure 4:
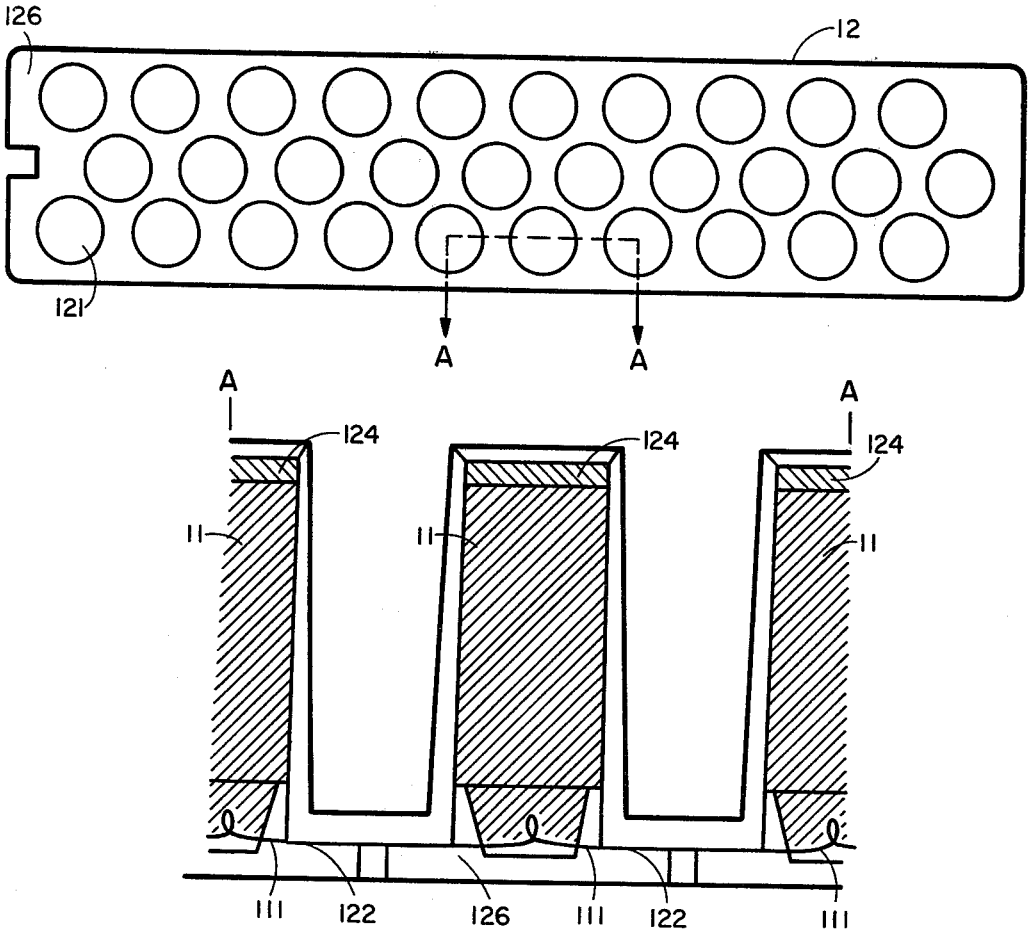
FIG. 4 is an illustration of the expendable within the firing unit.

Plastic expendable 12 is designed to be fabricated in an automatic process, thereby reducing cost. The configuration of expendable 12 is as shown in FIG. 4. Expendable 12 is a series of thirty cups 121, with bridge wire 111 at the bottom of each cup 121. Bridge wire 111 makes contact to a silk-screened conductive area 122 between each cup 121. Conductor area 122 makes contact with contact pins 221, thus connecting to firing control 90.

Referring to FIG. 3, each cup 121 has within it a pyrotechnic charge 11 which is a shaped pyrotechnic pellet composed of 75% potassium perchlorate, 15% black powdered aluminum, and 10% dextrose. Each pellet is sealed within a cup 121 by a plastic sealant 124 such as RTV silicone. The entire expendable structure is encased in a plastic casing 126.

The concept behind the small arms firing effect simulator is that of an electrical ignition of pyrotechnic charge 11 by heating bridge wire 111 to incandescence. Charge 11 burns in a combination mode to produce a quantity of combustion by-products, which, being contained in a fixed volume, produces a rapid increase in pressure. At some point, the pressure will be great enough to rupture plastic sealant 124 covering the exit orifice. The shock of the rupture and the ensuing venting of pressure from chambers 214 and 217 via exit port 211 produces overpressure levels and duration which simulate small arms fire.

While the invention has been described with reference to a preferred embodiment, it will be appreciated by those skilled in the art that additions, deletions, modifications, and substitutions or other changes not specified may be made which will fall within the purview of the appended claims.

What is claimed is:

1. A small arms fire simulator for use with a rifle utilizing the magazine, ejection port, and trigger of said rifle, comprising:

a plurality of pyrotechnic charges;

means for packaging said charges into a magazine for insertion into said rifle including:

an expendable plastic casing having configured therein a plurality of cylindrical wells having an exit orifice, for fixedly receiving said pyrotechnic charges;

ignition bridge wires embedded within each of said wells and within each of said pyrotechnic charges;

metal silkscreened conductive area connecting said bridge wires in adjacent wells; and means for electronically controlling the order and rate of discharge for said pyrotechnic charges operably connected to said charges and the trigger mechanism of said rifle.

2. The simulator of claim 1, wherein said pyrotechnic charges comprise a pyrotechnic mixture of 75% potassium perchlorate, 15% black powdered aluminum, and 10% dextrose, said charges shaped into cylindrical pellets, one end of which is configured as a truncated cone.

3. The simulator of claim 2, wherein said packaging means further comprises:

a plastic sealant for enclosing said pyrotechnic charges within said wells, said sealant covering said exit orifice;

a reusable housing having an upper end and a lower end, said upper end configured for insertion within the magazine of said rifle, said lower end comprising:

a receiver block configured so as to receive said plastic casing and provide electrical contact between said metal silkscreen and said electronic control means;

a chamber block hingedly affixed to said housing to contain said plastic casing in cooperation with said receiver block, said chamber block forming a lower exhaust chamber communicating with the exit orifice of said wells, said lower exhaust chamber being open at the hinged end of said chamber block;

said upper end of said reusable housing comprising: a battery compartment;

an upper exhaust chamber communicating with said lower exhaust chamber and the ejection port of said rifle; and a port spring mounted within said upper exhaust chamber to fixedly urge said housing within said rifle's magazine.

4. The simulator of claim 1, wherein said electronic control circuit comprises:

trigger interface means operably connected to be activated by pulling the trigger on said rifle;

a mode selection switch having safe, semi, and auto positions operably connected to said trigger interface means;

a power supply operably connected to supply electrical power to said circuit when said selector switch is in either the semi or auto position only;

a 10 Hertz oscillator connected to receive an input from said trigger interface means, outputting a signal via said auto position of said mode selector switch;

a bolt interface operably connected to provide an enabling input to said electronic control circuit when the bolt of said rifle is closed;

firing sensor means operably connected to said bolt interface to determine discharge of said pyrotechnic charges, outputting a signal based thereon;

oscillator control means for generating timing and enabling pulses operably connected to receive trigger pulses via said selector switch, receiving signals from said bolt interface and said firing sensor means;

a plurality of firing counters operably connected to receive timing signals from said oscillator control and enabling signals from said bolt interface, outputting coded firing signals;

a plurality of firing decoders operably connected to receive said coded firing signals and said timing signals, outputting a firing pulse in accordance with said coded firing signal, across one of a plurality of outputs; and firing control means operably connected to receive said firing pulse across said plurality of outputs, operably connected to said ignition bridge wires for igniting said pyrotechnic charges.

5. The simulator of claim 4, wherein said trigger interface comprises:

a dome switch having one side electrically grounded, physically positioned to close when said trigger is squeezed;

a first resistor electrically connected between said power supply and said dome switch providing a current path from said power supply to ground through said switch;

a second resistor having one end electrically connected at the junction of said first resistor and said dome switch;

a Schmitt trigger electrically connected between said second resistor and said semi position of said selector switch; and a capacitor having one side thereof grounded, operably connected to the junction of said second resistor and said Schmitt trigger.

6. A simulator according to claim 4, wherein said 10 Hertz oscillator comprises:

a first NAND gate having one input electrically connected to said semi position of said selector switch;

a second NAND gate having both inputs electrically connected to the output of said first NAND gate and its output electrically connected to said auto position of said selector switch;

a first resistive means having one end thereof electrically connected to the output of said first NAND gate;

capacitor means electrically connected between said auto position and said first resistive means; and a second resistive means providing a feedback path to said first NAND gate, having one end thereof connected to the second input of said first NAND gate and the other end thereof connected to a point between said first resistive means and said capacitive means.

7. A simulator according to claim 4, wherein said oscillator control comprises:

a D flip-flop clocked by a signal from said trigger interface, operably connected to said selector switch, having a state determining input from said bolt interface, and a reset input from said firing sensor, having an output to said firing decoder for enabling said decoder and a second output;

a 500 Hertz oscillator comprising:

a NAND gate receiving an input from the second output of said D flip-flop, having a second input and an output;

an inverter electrically connected to said NAND gate output, having an output;

first resistive means having one end connected to the output of said NAND gate;

capacitive means electrically connected between said inverter output and said first resistive means; and second resistive means providing feedback to said NAND gate second input, operably connected to said second input and to a point between said capacitance means and said first resistive means;

an oscillation control NAND gate receiving one input from said 500 Hertz oscillator and a second input from said bolt interface, and outputting timing pulses to said firing counter and said firing decoder on a dual line output; and an inverter receiving said output from one line of said oscillation control output, and outputting an inverted timing pulse to said firing counter and said firing decoder.

8. The simulator according to claim 4, wherein said bolt interface comprises:

a bolt microswitch operably mounted within said upper housing to cooperate with said rifle bolt to open and close the circuit;

a relay means operably connected between said microswitch and said power supply, said relay means providing connection means between said power supply and said firing control means;

a setting resistor having one end thereof connected to a point between said relay means and said microswitch;

a setting capacitor electrically connected between said setting resistor and ground;

a Schmitt trigger connected to receive input from a point between said setting resistor and said setting capacitor, outputting a signal based on said input;

a bolt interface flip-flop receiving a set input via said Schmitt trigger, having a reset input, input from said power supply, and output to said oscillator control means and said firing counters;

a reset resistor connected between said reset input and said power supply; and a reset capacitor connected between said reset input and ground.

9. The simulator of claim 4, wherein said selector switch is a ganged switch combination such that said auto and semi positions provide circuit continuity between said trigger interface and said oscillation control means, and circuit continuity between said power supply and the remainder of said electronic control circuit, and said off position provides an open circuit from said trigger interface to said oscillation control means and from said power supply.

10. The simulator of claim 4, wherein said firing sensor comprises:

a first resistor having one end connected to said power supply;

a voltage comparator having a plus and a minus input and an output, said output connected to said first resistor;

a second resistor connected to said plus input;

a third resistor connected between said second resistor and ground;

a first diode with its anode connected to said power supply and its cathode connected to a point between said second and third resistors;

a second diode with its anode connected to said power supply;

a third diode with its anode connected to the cathode of said second diode;

a capacitor connected between said third diode's cathode and ground;

a fourth resistor connected between said minus input and said third diode's cathode;

an output from said third diode's cathode to said firing control operably connected thereto through said bolt interface; and an inverter connected between the output of said voltage comparator and said oscillator control.

11. The simulator of claim 4, wherein said firing counters are a dual binary counter receiving timing pulses from said oscillator control means, also receiving reset inputs from said bolt interface, outputting a pair of timing pulses to said firing decoders.

12. The simulator of claim 4, wherein said firing decoders are two 4-bit latch/4 to 16 line decoders receiving coded timing pulses from said firing counters, each outputting a single pulse to the appropriate line of its sixteen outputs.

13. The simulator of claim 4, wherein said firing control means comprises:

thirty-one silicon controlled rectifiers and sixty-two resistors, said resistors being ordered into thirty-one pairs, each pair connected in series between one of the plurality of outputs of said firing decoders and ground to form thirty-one voltage dividers, each silicon controlled rectifier having its gate connected to the center of one of said voltage dividers, sixteen of said SCR's having their anodes connected in parallel to said power supply via said bolt interface and having their cathodes connected to the appropriate side of said bridge wire ignition means for each pyrotechnic charge, the remaining fifteen SCR's having their anodes connected to the remaining sides of said bridge wire ignition means and having their cathodes connected to ground.

* * * * *